United States Patent [19]

Tavin

[11] Patent Number: 4,516,421

[45] Date of Patent: May 14, 1985

[54] DEVICES FOR MANUFACTURING ANNULAR FRAMES FOR SEALS AND TO THE CORRESPONDING FRAMES AND SEALS

[75] Inventor: Gérard Tavin, Segre, France

[73] Assignee: Hutchinson, Paris, France

[21] Appl. No.: 417,337

[22] Filed: Sep. 13, 1982

[51] Int. Cl.[3] ..... B21D 22/00

[52] U.S. Cl. ..... 72/354; 72/359; 72/466

[58] Field of Search ..... 72/347, 348, 356, 358, 72/359, 354, 352, 465, 466

[56] References Cited

U.S. PATENT DOCUMENTS 3,197,996 8/1965 Zeder, Jr. ..... 72/354

3,314,266 4/1967 Werther et al. ..... 72/359

*Primary Examiner*—Leon Gilden

*Attorney, Agent, or Firm*—Larson and Taylor

[57] ABSTRACT

To produce an annular metal frame having an L shaped half-section for a lipped seal, a metal strip is cut into lengths, each of these lengths is rolled up circularly until its two ends are in abutment, so as to form a cylindrical ring (7), then this ring is driven into the cavity of small thickness defined between two parallel guide surfaces (S, S'), the entrance to said cavity having a shape complementary to that of the ring and the bottom of the cavity having a shape complementary to that of the frame to be produced.

2 Claims, 6 Drawing Figures

Fig.2.
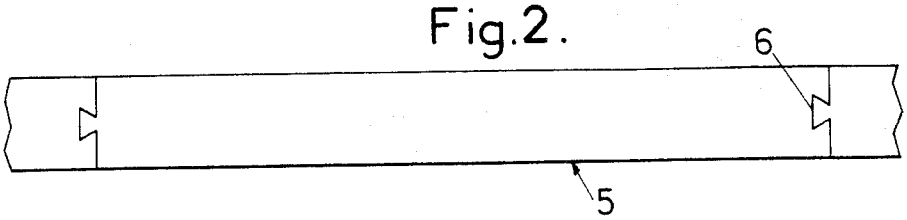
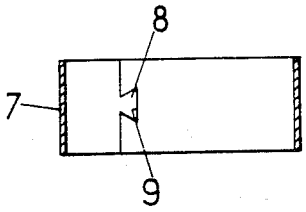
Fig.3.
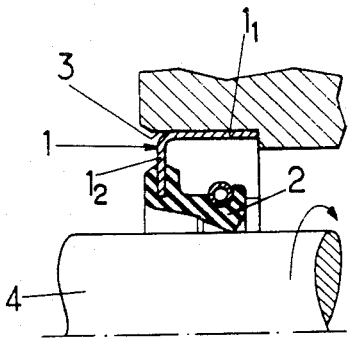
Fig.1.
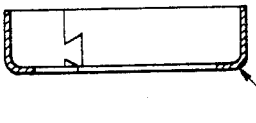
Fig.4.
Fig.5.
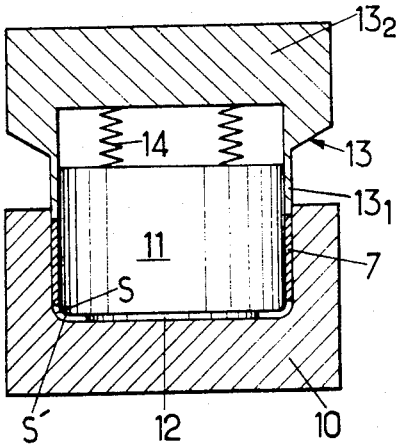
Fig.6.
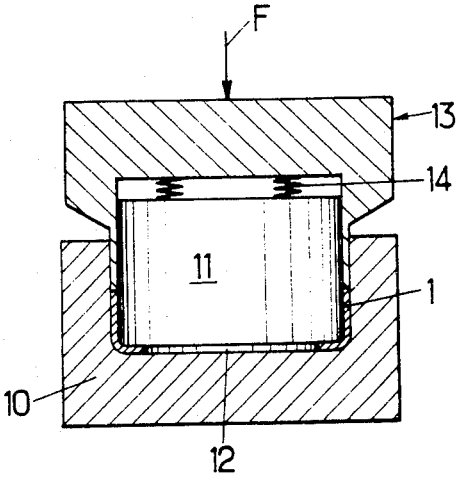

DEVICES FOR MANUFACTURING ANNULAR FRAMES FOR SEALS AND TO THE CORRESPONDING FRAMES AND SEALS

The invention relates to annular metal reinforcement frames for annular seals providing the seal between a rotary shaft and its housing as well as the processes and devices for manufacturing these frames.

It relates more particularly still, but not exclusively, among said frames, to those for reinforcing lipped seals and formed by rings having in axial half-section the shape of an L or of a right-angle.

In known embodiments of these annular frames, these latter are generally formed by cutting out flat disks from a metal sheet and stamping these disks.

This process leads to the formation of corrugations or other irregularities in the pressed blanks and especially to the creation of very numerous scraps, the volume of this scrap waste being possibly greater than that of the metal forming the frames.

To remedy these disadvantages, it has already been proposed to begin by cutting a metal strip into lengths, then in rolling each of these lengths circularly until its two ends are in abutment so as to form a cylindrical ring, and finally in transversely deforming said ring so as to give it the shape of the desired frame.

This known process, it is true, reduces the metal waste.

But for the transverse deformation of the ring according to this process, several successive die-stamping steps must be performed, the final step being preceded by an independent pre-forming step which consists in turning over slightly inwardly of the ring, like an internal chamfer, one of the axial borders of this ring, which border has been previously slashed with triangular notches for overcoming the risks of corrugations.

This process is relatively long and costly, leads to metal waste due to the notches and the frames obtained have a certain fragility because of the very fact of the presence of slits corresponding to these notches.

The aim of the invention is, on the one hand, to improve the manufactured frames, the circular edges of these frames being continuous outside the zone corresponding to the previous abutment and the different portions of these frames being however defined by smooth surfaces free of corrugations, some of the portions being even locally stronger than the original strip and, on the other hand, to make the production of said frames more rapid and more economical, their transverse deformations being carried out in a single pass.

To this end, the transverse deformation of each ring is essentially provided, in accordance with the invention, by axially driving said ring, in a single pass, into an annular cavity of small thickness defined between two parallel guide surfaces (S,S'), the entrance of which cavity has a shape complementary to that of the ring and whose bottom has a shape complementary to that of the frame to be produced.

The device for implementing this deformation process is itself essentially characterized according to the invention in that it comprises an external pot, a central mandrel adapted to be placed on the bottom of the pot, inside this latter, and arranged so that its external surface (S') defines with the internal surface (S) of the pot the annular cavity of small thickness adapted to jointingly receive and guide the ring during its deformation and a bell-shaped punch with thin cylindrical skirt whose skirt is adapted and mounted so as to slide axially and jointingly in the entrance of said volume, the cross section of this skirt having the shape of a ring whose dimensions are identical to that of the edge of the ring to be driven.

According to a preferred embodiment, the device in question further comprises resilient compression means interposed axially between the mandrel and the roof of the bell-shaped punch so as to apply the mandrel firmly against the bottom of the pot during formation of the frame by driving the ring, while allowing not only the punch but also the mandrel to be easily released from the pot after formation of each frame, so as to allow this frame to be removed from said pot.

The invention comprises, apart from these main arrangements, certain other arrangements which are preferably used at the same time and which will be more explicitly discussed hereafter.

In what follows, a preferred embodiment of the invention will be described with reference to the accompanying drawings, in a way which is of course in no wise limiting.

FIG. 1, of these drawings, shows in axial half-section a lipped seal equipped with a metal annular frame in accordance with the invention;

FIG. 2 shows in a top view a metal strip from which such frames in accordance with the invention are produced;

FIG. 3 shows in axial section a cylindrical ring representing the intermediate phase of such manufacture;

FIG. 4 shows in axial section a frame produced in this way; and

FIGS. 5 and 6 show in schematical axial sections in two successive operating stages a forming machine constructed in accordance with the invention for forming a frame such as the one in FIG. 4 from a ring such as the one in FIG. 3.

In the embodiment considered here, it is proposed to manufacture the annular frame 1 fitted to a lipped seal 2 for mounting in a cylindrical bearing 3 and for providing sealing around a rotary shaft 4 passing through this bearing.

The annular seal 1, here visible, is forcibly fitted into bearing 3 and has in axial half-section the shape of an L or of a right angle one leg $\mathbf{1}_1$ of which extends parallel to the axis of the frame and the other leg $\mathbf{1}_2$ of which extends radially towards said axis from the first leg.

To manufacture such a frame, a metal strip 5 (FIG. 2) is required whose nature and dimensions are chosen depending on the end use of said frame.

The thickness of this strip 5 is generally between 0.3 and 1.5 mm, being preferably of the order of 0.6 to 0.8 mm.

The width of said strip is generally between 5 and 30 mm, being preferably of the order of 10 to 20 mm.

As for the material forming this strip, it is in general steel, possibly stainless steel or brass.

From this strip 5 are cut out sections of identical length along lines perpendicular to the length of said strip or preferably along broken swallow-tail shaped lines 6.

Then each of these sections thus cut out is rolled up until its two ends come into abutment so as to form a ring, cylindrical in revolution, 7 (FIG. 3).

Although it is not indispensable, this cylindrical shape may be held in position by mutual coupling of the adjacent ends of the section, more especially by welding, bonding or by clipping these ends together, then cut out along the broken lines 6, by introducing the tenon 8 projecting from one of these ends into the mortice 9 of complementary shape, cut out in the other end, as can be seen in FIG. 3.

To transform this cylindrical ring 7 then into the desired annular frame 1 (FIGS. 1 and 4), the ring is driven axially into a sort of mold defined by appropriate guide surfaces.

The Applicant has in fact discovered that, if these surfaces are designed so as to guide the ring along its two faces, during the whole of the deformation thereof, in a jointing way, i.e. without jamming and without floating, the desired deformation may be very simply obtained and under excellent conditions by such driving effected in a single pass, even when cold.

To form these guide surfaces, recourse is had to a device comprising:

a pot 10 whose internal cavity is defined by a surface S formed in the lower part by a flat horizontal bottom and sidewise by a cylindrical face of revolution with vertical axis, such bottom and cylindrical face being mutually connected together by an annular bend of rounded section, a mandrel, cylindrical in revolution, 11 adapted to rest on the bottom of pot 10 through a circular disk 12 forming preferably an integral part of this mandrel, the external surface S' of this mandrel extending, when this latter rests on the bottom of the pot, inside the inner surface S of said pot, parallel thereto and separated therefrom by a small distance slightly greater than the thickness e of the ring 7 to be deformed, and a bell-shaped punch 13 covering mandrel 11, the active annular part of this punch forming a cylindrical skirt $13_1$ accommodated jointingly between the upper cylindrical areas opposite surfaces S and S' and finishing in the lower part in an annular surface of the same dimensions as the edge of the ring 7 to be driven.

In other words, this cylindrical skirt $13_1$ has a radial thickness equal to e.

Said skirt is then extremely thin, the value e being generally less than 1 mm whereas its axial length is generally greater than 10 mm.

To prevent this skirt from being deformed when it axially drives ring 7, it is made from a mechanically very strong material, for example from steel having a tensile strength between 160 and 200 kg/mm$^2$, but it should be noted that the jointing guiding thereof between the two surfaces S and S' during the driving work thereof already excludes to a large extent risks of deformation thereof.

Resilient means 14 are interposed between the roof $13_2$ of the bell punch and mandrel 11 so as to apply this mandrel with sufficient force against the bottom of pot 10, during driving of ring 7, for the mutual contact between these two elements to be maintained despite the force exerted to separate them by the driving itself.

These resilient means 14 may be formed by springs, for example of the helical type as shown schematically in FIGS. 5 and 6 or in any other desirable way, for example by means of pneumatic or hydraulic members.

Means not shown are further advantageously provided for connecting together mandrel 11 and punch 13 while limiting their axial mutual spacing; thus mandrel 11 may be easily freed at the same time as punch 13 from the pot after the manufacture of each frame 1 for removing this frame from the pot.

For shaping such a frame, the procedure to follow is as set out herebelow.

With the mandrel 11—punch 13 assembly removed from pot 10, there is then placed in its cavity, open at that time at the top, a ring 7 whose external surface is jointingly applied against the inner face S of said cavity.

Then mandrel 11 and punch 13 are fitted into the pot this equipped, this fitting being able to be facilitated by appropriate guide means such as chamfered surfaces, until the mandrel comes vertically into contact against the bottom of the pot and the punch comes vertically into contact with the upper edge of ring 7 (see FIG. 5).

Then punch 13 is pressed down, in the direction of arrow F in FIG. 6, so as to force its skirt $13_1$, forming its active part, into the annular gap between pot and mandrel.

Such forcing results in compressing the springs 14—which firmly applies mandrel 11 against the bottom of pot 10—and especially in driving ring 7 downwards while causing the metal forming the base of this ring to flow into the only volume available for it, namely the annular space included vertically between the periphery of the top of the mandrel and the periphery of the bottom of the pot, said metal being thus forced to flow radially into this space in the direction of the axis of the assembly until said space is filled, as can be seen in FIG. 6.

The forming operation is then finished.

Then the mandrel 11 and punch 13 assembly is removed vertically from pot 10, for which it is sufficient to raise punch 13, which operation results successively in punch 13 and mandrel 11 moving relatively apart, accompanied by relaxation of springs 14, then in the mandrel itself being freed from the pot.

The frame 1 shaped and located at the bottom of this pot may then be removed from the pot in its turn.

The surface of the frame thus obtained is strictly complementary with the areas of the guide surfaces S and S' between which this frame is imprisoned at the end of formation thereof.

In particular, said surface is at all points perfectly smooth and free of corrugations or other irregularities if the areas in question comply with these conditions, which provides in particular a good seal between the frame and a housing with complementary smooth surface by simple force fitting of this frame into this housing as is the case in the embodiment of FIG. 1.

It should be noted that, because of such force fitting, frame 1 is under a radial compression which firmly applies together the two ends "abutted" one on the other of the strip length forming the frame: this firm application ensures by itself a good seal at the level of the discontinuity of the ring.

But in general it is not even necessary for the application of the two abutted ends to be provided sealingly since the frame is in most cases entirely buried in a mass of rubber or elastomer: this is why it is very often sufficient for both ends considered to be simply "juxtaposed" and not "clipped together" one to the other.

It should further be noted that the manufacture of frames 1 is provided without any waste other than some ends of the starting strips 5: in particular no waste follows from notches cut out in order to prevent corrugations. The resulting economy from this absence of waste is very high in practice.

It will also be noted that the frames obtained are stronger than those obtained with the prior process described above, because of the absence of notches in their circular edges.

Moreover, the axial driving described above results is densifying, even slightly thickening the cylindrical portion of each frame corresponding to the leg $1_1$ of its axial half-section, which reinforces the mechanical strength of this frame.

Each of the frames shaped in accordance with the invention is identifiable by the fact that on it can be seen the trace of the mutual "abutment" of the two ends of the rolled strip length which forms it.

Following which and whatever the embodiment adopted, there are finally provided processes and devices for manufacturing annular frames for lipped seals or similar whose characteristics, implementation and advantages follow sufficiently from what has gone before.

As is evident and as it follows moreover already from what has gone before, the invention is in no wise limited to those of its modes of application and embodiments which have been more especially considered; it embraces, on the contrary, all variations thereof, particularly: p those where the axial driving of the ring is not carried out when cold but at a temperature higher than the ambient temperature, those where the axial half-section of the manufactured frame has a shape other than that of an L, for example that of a V, or else that of a J, or even that of a Z, those where the starting strip lengths are obtained not by transversely cutting out a narrow strip, the cut-outs then corresponding to the small sides of the sections obtained, as shown in FIG. 1, but by transversely cutting out a wide strip, the cut-outs then corresponding to the large sides of the sections obtained.

I claim:

1. A device for deforming a cylindrical ring into an annular metal frame for a seal having an annular portion at one end and a radially directed lip portion at the other end, comprising:

an external pot including a bottom and an inner annular surface defining a cylindrical cavity, a central mandrel located inside of said cavity, said mandrel being cylindrically shaped to mate with the bottom of the pot to define a radially directed cavity and arranged so that the outer surface of the mandrel defines with the inner annular surface of the pot an annular cavity of small thickness adapted to jointingly receive and axially guide the ring during deformation thereof, and a bell-shaped punch having a thin cylindrical skirt dimensioned and mounted to slide axially and jointingly into the entrance of said annular cavity, the radial cross section of said skirt having the shape of a ring identical to the radial cross section of the edge of the ring to be driven, said skirt comprising means for engaging the edge of the ring to drive the opposite end of the ring down into the radially directed cavity upon downward movement of the punch and skirt to form the radially directed portion of the metal frame.

2. The device according to claim 1, including resilient compression means interposed axially between the mandrel and the bell-shaped punch so as to firmly apply the mandrel against the bottom of the pot during formation of the frame by driving in the ring while allowing not only the punch, but also the mandrel, to be easily removed from the pot after formation of each frame, so as to allow this frame to be removed from this pot.

* * * * *